US009797665B2

(12) United States Patent
Müller-Lufft et al.

(10) Patent No.: US 9,797,665 B2
(45) Date of Patent: Oct. 24, 2017

(54) HEAT EXCHANGER WITH COMMON SEAL AND FLOW DETECTOR COMPONENT

(75) Inventors: Stefan Müller-Lufft, Leonberg (DE); Wolfgang Münz, Reutlingen (DE); Thomas Ritter, Sindelfingen (DE)

(73) Assignee: Modine Manufacturing Company, Racine, WI (US)

( * ) Notice: Subject to any disclaimer, the term of this patent is extended or adjusted under 35 U.S.C. 154(b) by 2247 days.

(21) Appl. No.: 12/738,247

(22) PCT Filed: Oct. 11, 2008

(86) PCT No.: PCT/EP2008/008609

§ 371 (c)(1),
(2), (4) Date: Apr. 15, 2010

(87) PCT Pub. No.: WO2009/059678

PCT Pub. Date: May 14, 2009

(65) Prior Publication Data

US 2010/0206516 A1 Aug. 19, 2010

(30) Foreign Application Priority Data

Nov. 6, 2007 (DE) ..... 102007052706.5

(51) Int. Cl.

| | |
|---|---|
| ***F28F 1/14*** | (2006.01) |
| ***F28F 27/02*** | (2006.01) |
| ***F01M 5/00*** | (2006.01) |
| ***F28D 9/00*** | (2006.01) |
| *F28D 21/00* | (2006.01) |

(52) U.S. Cl.
CPC ..... *F28F 27/02* (2013.01); *F01M 5/002* (2013.01); *F28D 9/005* (2013.01);
(Continued)

(58) Field of Classification Search
CPC .... F28F 27/02; F28F 2250/06; F28F 2265/12; F28D 9/005; F28D 2021/0049; F28D 2021/0089; F01M 5/002
(Continued)

(56) References Cited

U.S. PATENT DOCUMENTS

| | | | | |
|---|---|---|---|---|
| 5,499,675 | A * | 3/1996 | Haasch et al. | 165/103 |
| 5,544,699 | A * | 8/1996 | Robers et al. | 165/283 |
| 5,609,476 | A * | 3/1997 | Kim et al. | 417/447 |

(Continued)

FOREIGN PATENT DOCUMENTS

| | | |
|---|---|---|
| CA | 2504526 | 10/2006 |
| DE | 3923936 | 1/1991 |

(Continued)

OTHER PUBLICATIONS

PCT/EP2008/008609 International Search Report dated Feb. 10, 2009 (6 pages).

(Continued)

*Primary Examiner* — Travis Ruby
(74) *Attorney, Agent, or Firm* — Michael Best & Friedrich LLP

(57) ABSTRACT

A heat exchanger includes a stack of plates which form ducts. Each of the plates can have at least two openings which, in the plate stack, form at least one collecting duct and one distributor duct which connect the ducts in terms of flow. A base plate can be arranged on the plate stack and can have a seal for sealing off the heat exchanger and a flow deflector for manipulating flow through the heat exchanger. The seal and the flow deflector can form a common component.

20 Claims, 4 Drawing Sheets

(52) U.S. Cl.
CPC ..... *F28D 2021/0049* (2013.01); *F28D 2021/0089* (2013.01); *F28F 2250/06* (2013.01); *F28F 2265/12* (2013.01)

(58) Field of Classification Search
USPC ..... 165/283, 284, 286, 41, 103, 166, 167; 236/34.5, 92 R, 92 C
See application file for complete search history.

(56) References Cited

U.S. PATENT DOCUMENTS

| | | | | |
|---|---|---|---|---|
| 7,735,520 | B2 * | 6/2010 | Peric | 137/855 |
| 2006/0237184 | A1 * | 10/2006 | Peric | 165/283 |

FOREIGN PATENT DOCUMENTS

| | | |
|---|---|---|
| DE | 19539255 | 4/1997 |
| DE | 102005041036 | 3/2007 |
| EP | 1715146 | 10/2006 |
| EP | 1715147 | 10/2006 |
| EP | 1772693 | 4/2007 |
| JP | 2004346916 | 12/2004 |
| WO | 2006/097086 | 9/2006 |

OTHER PUBLICATIONS

Office Action from the State Intellectual Property Office of the People's Republic of China for Application No. 200880115038.6 dated Jul. 2, 2012 (Statement of Relevance Attached, 4 pages).
PCT/EP2008/008609 International Preliminary Report on Patentability dated Jun. 1, 2010 (6 pages).

* cited by examiner

HEAT EXCHANGER WITH COMMON SEAL AND FLOW DETECTOR COMPONENT

CROSS-REFERENCE TO RELATED APPLICATIONS

This patent application is a national stage filing under 35 U.S.C. 371 of International Application No. PCT/EP2008/008609, filed Oct. 11, 2008, and claims priority to German Patent Application No. 10 2007 052 706.5, filed Nov. 6, 2007, the entire contents of both of which are incorporated herein by reference.

FIELD OF THE INVENTION

The invention relates to a heat exchanger (e.g., an oil cooler).

SUMMARY

DE 195 39 255 A1 discloses an oil cooler. In FIG. 5 of said document, a valve which is responsive to pressure, is provided as a flow deflecting means, which valve is situated at an opening of the distributor duct in said figure. The valve has the task of allowing cold and therefore still viscous oil, whose pressure is correspondingly high, to pass through the heat exchanger without having to flow through the ducts of the heat exchanger, in the manner of a bypass. In this way, the oil in the heat exchanger is not cooled and can reach its operating temperature more quickly. When said temperature is reached, the oil becomes less viscous, the pressure decreases and the valve closes the bypass, as a result of which the oil cooling in the ducts is initiated. The heat exchanger from said document also has sealing means. These are rubber seals which engage annularly around the openings of the collecting duct and seal off said openings in the direction of a transmission. The flow deflecting means and the sealing means must be attached to the heat exchanger after the latter is soldered.

EP 1 772 693 A1 discloses an oil cooler in which a valve which is responsive to pressure is duly likewise provided as a flow deflecting means, but said valve—in contrast to the prior art described above—is inserted into the heat exchanger before the soldering process and is soldered together with the heat exchanger. The document does not refer to sealing means, but these must regularly belong to such heat exchangers.

Patent applications EP 1 715 146 A1, EP 1 715 147 A1 and in WO 2006/097086A1 disclose other conventional heat exchangers.

It is the object of the invention to simplify the production, and, if appropriate, also the assembly of the heat exchanger.

In the present invention, because the sealing means and the flow deflecting means are formed as a common component—that is to say in one piece—production is simplified because the present invention includes fewer parts than conventional heat exchangers. The flow deflecting means is preferably a valve which is responsive to a change in pressure. Applications are however also notionally to be encompassed in which the flow deflecting means is a rigid element which can merely deflect the flow in a certain desired direction. The common component is inter alia also fastened to the heat exchanger, such that it cannot become lost during further production or assembly.

The invention will be described below in terms of a plurality of exemplary embodiments on the basis of the appended drawings. The description contains further features and their advantages.

DETAILED DESCRIPTION

Figure 1:
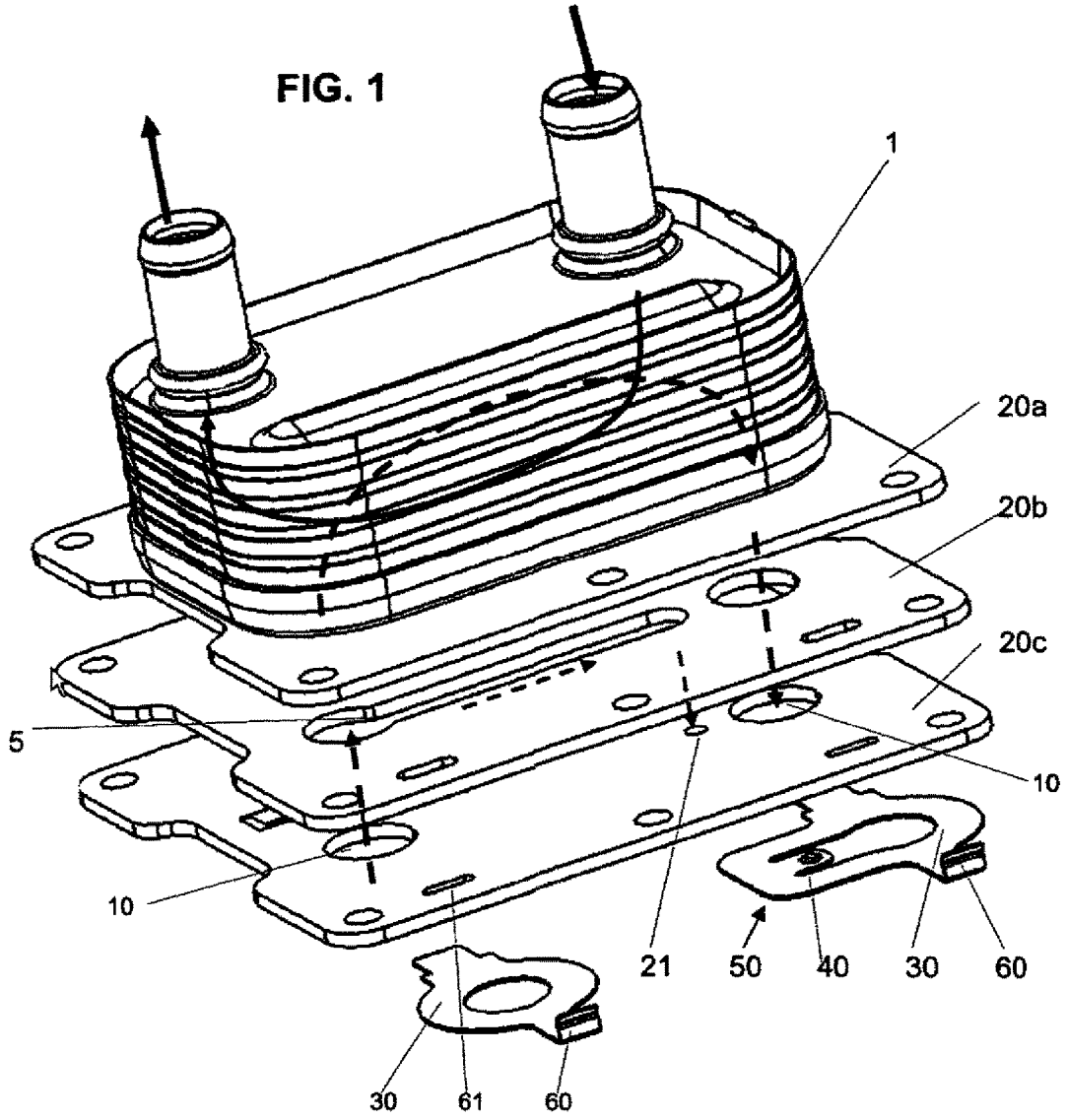
FIG. 1—is a perspective view of an oil cooler, partially in an exploded illustration.

The exemplary embodiments show a so-called housingless heat exchanger as an oil cooler, the plates 1 of which have four openings 10. The openings 10—only two of which are visible—form a collecting duct 12 and a distributor duct 11 for the outflowing and inflowing medium, in this case for the oil. Other ducts which are arranged between the plates 10 and which are likewise not visible in the drawing branch off from said ducts 11, 12. A corresponding design is also provided on the coolant side. In FIG. 1, arrows have been plotted which are intended to indicate that a liquid coolant flows in and out at the top. In contrast, the oil flows in and out at the bottom, as indicated by the arrows with the dashed lines.

The present invention may be used in heat exchangers whose plates 1 have merely two openings 10 and which accordingly have only one collecting duct and one distributor duct. The other medium flows in at a housing surrounding the plate stack, flows through between the spaced-apart plates, and flows out again usually at a different location of the housing. This type of heat exchanger is also well known, and therefore an illustration is omitted here.

Figure 2:
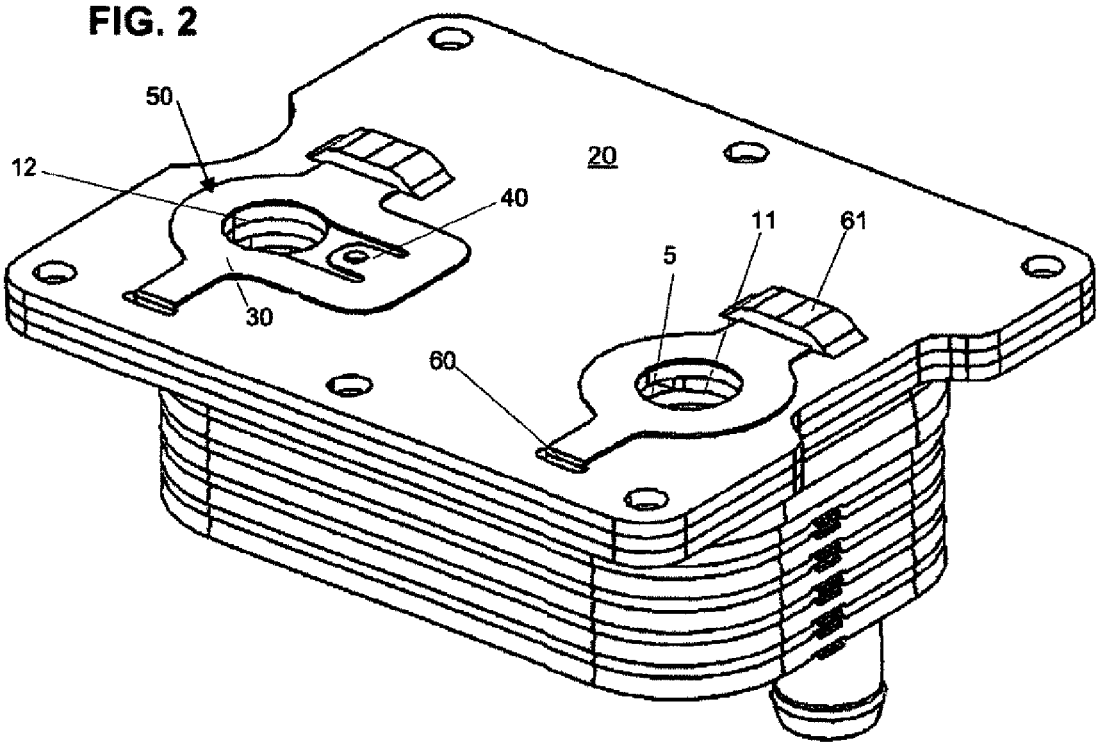
FIG. 2—is another perspective a view of the oil cooler of FIG. 1.

Returning to the embodiments shown, in which a base plate 20 is situated on the plate stack. By means of said base plate 20, the oil cooler is attached to an assembly (not shown), for example to a transmission or engine housing, the oil of which is to be cooled or temperature-controlled. In the exemplary embodiment shown, the base plate 20 is composed of three planar plates 20*a*, 20*b*, 20*c*. Arranged on the lowermost plate 20*c* is a common component 50 which comprises a sealing means 30 and a flow deflecting means 40. In the exemplary embodiment, the common component 50 is composed of metal, for example of a high-grade steel of class 1.4310, which also has suitable elastic properties. The sealing means 30 is formed in the manner of a metal bead seal. The encircling bead 31 is visible in FIGS. 6 and 7. Said bead 31 is elastically deformed by contact pressure forces and provides the sealing action even if the surfaces are not completely planar. Here, the flow deflecting means of the common component 50 is a valve 40 which is responsive to pressure. In FIGS. 1 and 2, the valve 40 is in the closed position. In said position, the sealing means 30 and the valve 40 lie approximately in a plane. It can also be seen from the illustrations that the common component 50 can be produced by means of simple shaping steps. A further advantage of said arrangement is that the common component 50 can be attached after the soldering of the oil cooler, without the need for any insertion openings, which must be closed off again after the insertion, for the valve 40.

In embodiments which are not shown, a rigid element is provided as a flow deflecting means 40, by means of which element, for example, the flow passing through the ducts can be deflected to plate regions through which otherwise very little flow passes or—more generally and in other words—in order to manipulate the throughflow.

The common component 50 has bent-up hooks which serve as fastening means 60 and which engage into corresponding slots 61 or the like in the base plate 20. The common component 50 is thereby fixed in position and also cannot be lost during the course of further machining.

It should also be pointed out at this juncture with regard to the common component 50 that it is not of primary importance for the sealing means 30 and the flow deflecting means 40 to be composed of an identical material, but it is rather the commonness of the component 50 that is of importance. For example, the sealing means 30 may be composed of a suitable rubber on which the flow deflecting element 40, which is composed for example of metal, is vulcanized. All this is merely a question of costs and expedience for the specific situation. It should also be pointed out that the valve 40 could also be a bimetal which, in a known way, has the characteristic of being responsive to temperature changes.

Figure 5:
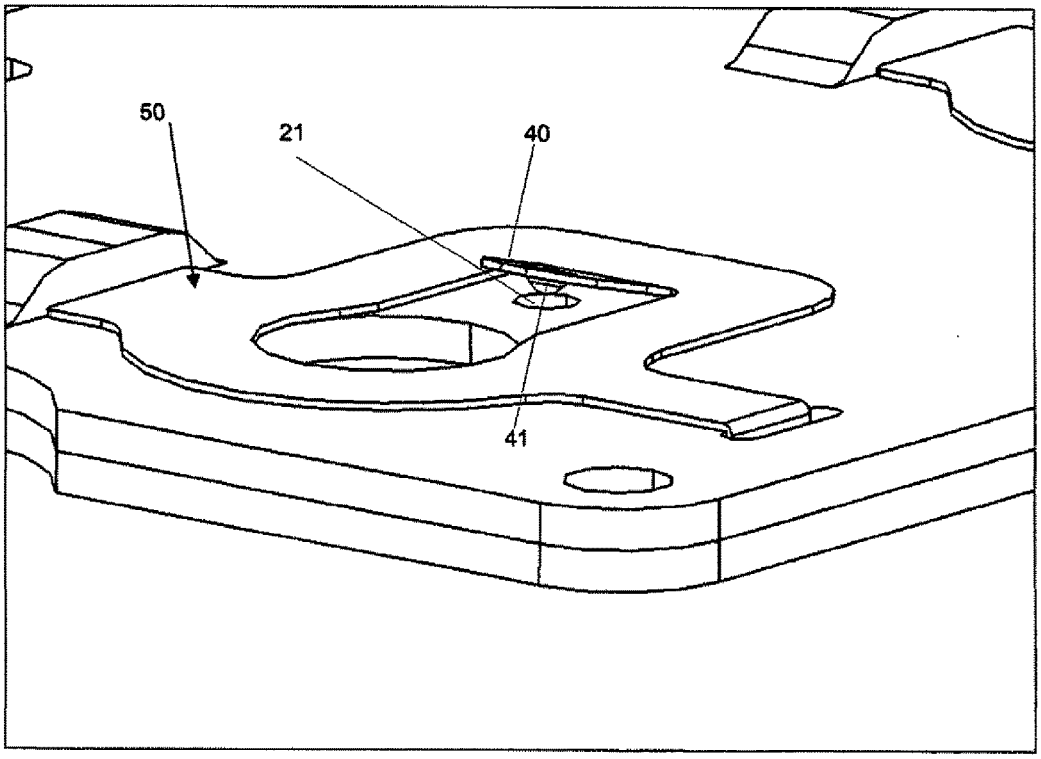
FIG. 5—is an enlarged detail showing the common component.

The base plate 20 already mentioned above as being in three parts has, in its central plate 20*b*, an elongate duct which acts as a bypass duct 5 and which is arranged in a very space-saving manner. The plates of the base plate 20 are of comparatively thin-walled design. Said bypass duct 5 is connected, at one side, to the distributor duct 11. At the other side, the bypass duct 5 is connected to an aperture 21 formed in the lowermost plate 20*c*. The aperture 21 is closed off by the valve 40 in normal operation of the oil cooler, such that the oil must flow through the ducts (not shown) between the plates 1, and thereby be cooled by means of the cooling liquid flowing in the other ducts (not shown) between the plates 1, before emerging from the oil cooler again via the collecting duct 12. In the start phases, however, when the oil is cold and viscous, said oil will not allow itself to be forced through the narrow ducts, which leads to a considerable increase in pressure of the oil. Said pressure rise also causes the valve 40 to open and therefore to open up the described bypass path which leads directly back into the collecting duct 12 and into the assembly. The detail in FIG. 5 shows precisely this situation, specifically the valve 40 in the open position. In said position, the valve 40 is at an acute angle with respect to the plane of the sealing means 30. FIG. 5 also shows that it is expedient for the valve 40 to be formed with an areal molding 41 which is matched in terms of dimensions to the aperture 21, as a result of which the sealing action of the valve 40 can be improved.

The design proposed here may also be used in a combination of the oil cooler with an oil filter. Furthermore, in contrast to the above description, provision may also be made for the common component 50 to be arranged in connection with the coolant ducts in order to obtain desired advantageous effects. In these cases in particular, the valve 40 could—as already mentioned above—be a valve which is responsive to temperature changes of the coolant. These embodiments which are also encompassed by the proposal also show that the component 50 need not be designed as a component 50 which is of flat overall design. In other applications, the valve 40 or the flow deflecting means may be arranged bent out singly or multiply from the plane of the sealing means 30.

Figure 3:
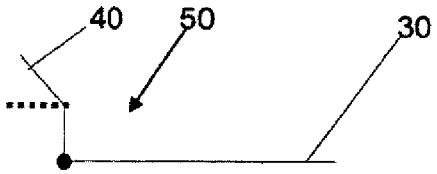
FIG. 3—illustrates another common component.
Figure 4:
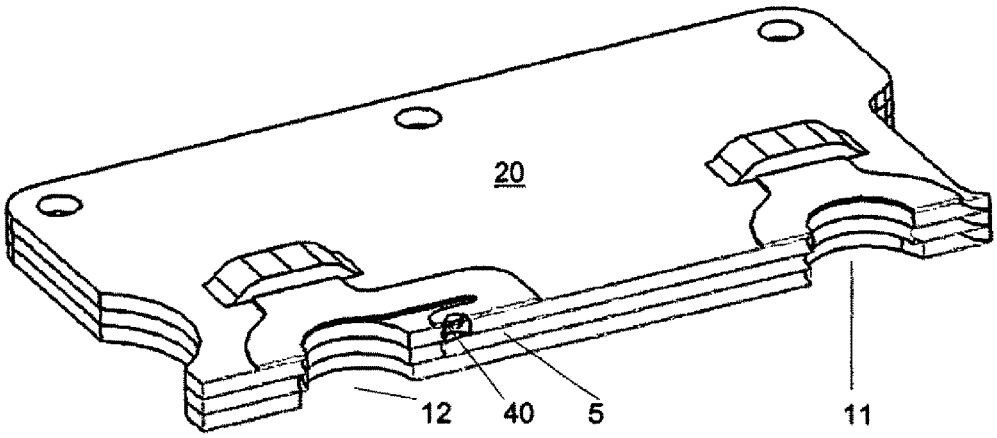
FIG. 4—is a longitudinal section taken through the base plate of the oil cooler.

FIG. 3 shows, purely diagrammatically, a common component 50 of said type in which the valve 40 has been arranged bent out of the plane of the seal 30 in order to be suitable for other situations or else for other bypass arrangements. The dotted line is intended here to indicate the open or the closed position of the valve 40.

Figure 6:
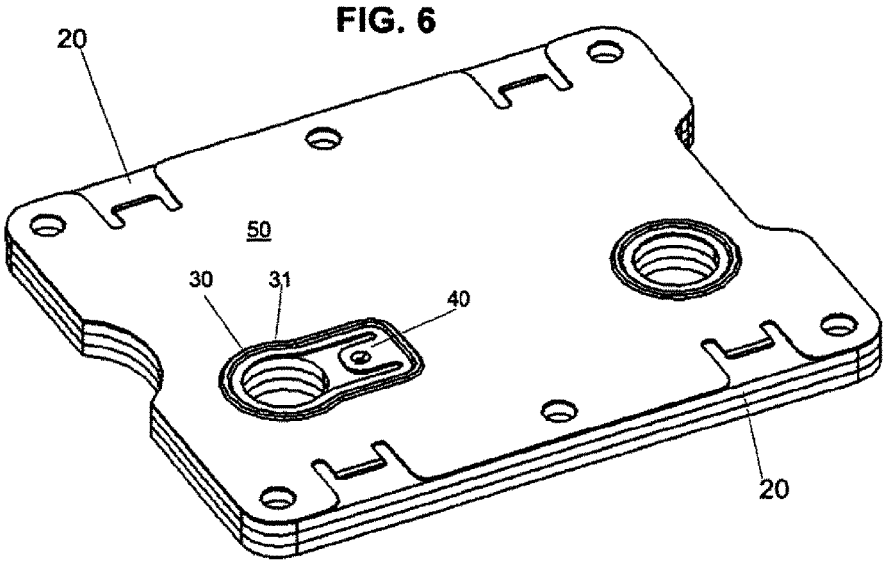
FIGS. 6 and 7—illustrate a third exemplary embodiment in perspective views.
Figure 7:
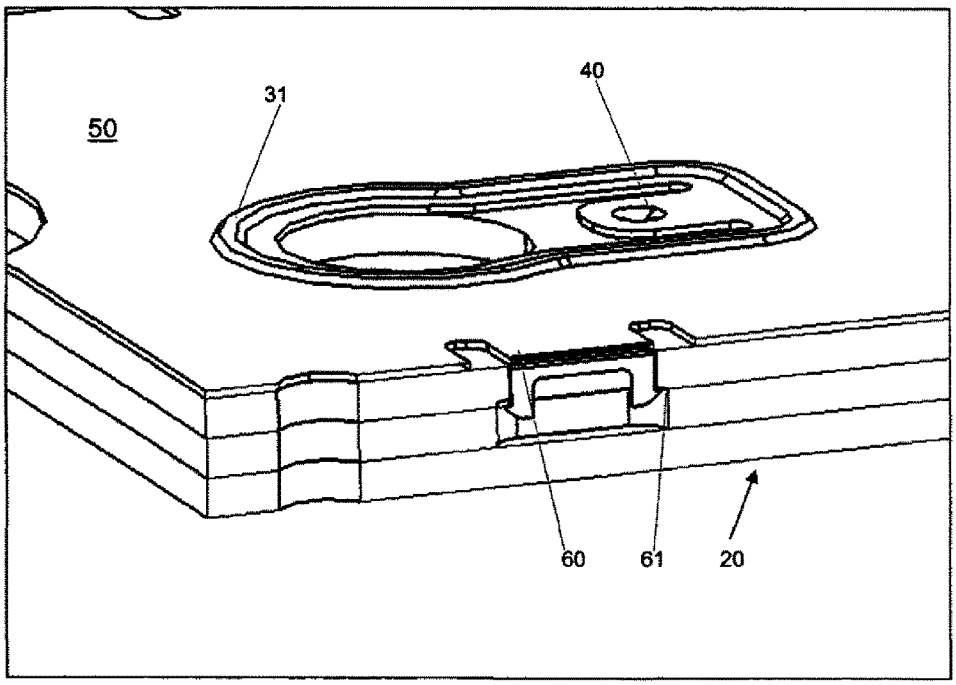

FIGS. 6 and 7 now show another exemplary embodiment which is advantageous for some applications and which differs from the exemplary embodiment already described in that the common component 50 extends virtually over the entire area of the base plate 20.

The invention claimed is:

1. A heat exchanger, comprising:

a stack of plates which form ducts, with each of the plates having at least two openings which, in the plate stack, form at least one collecting duct and one distributor duct which connect the ducts in terms of flow, and a base plate arranged on the plate stack and having a seal for sealing off the heat exchanger and a flow deflector for manipulating the flow through the heat exchanger, the base plate including a first substantially planar base plate having a first opening fluidly coupled to the collecting duct and a second opening fluidly coupled to the distributor duct, a second substantially planar base plate having a third opening fluidly coupled to the first opening and the collecting duct and a fourth opening fluidly coupled to the second opening and the distributor duct, a third substantially planar base plate having a fifth opening fluidly coupled to the first opening, the third opening and the collecting duct and a sixth opening fluidly coupled to the second opening, the fourth opening and the distributor duct, wherein the second base plate is positioned between the first base plate and the third base plate, wherein the base plate forms a bypass duct that fluidly couples the collecting duct and the distributor duct, wherein the flow deflector is moveable between a first position in which flow of fluid through the bypass duct is inhibited and a second position in which flow of fluid through the bypass duct is permitted, wherein the seal and the flow deflector form a common component, and wherein the seal is a metal bead seal.

2. The heat exchanger as claimed in claim 1 wherein the seal engages around the opening of one of the collecting duct and the distributor duct.

3. The heat exchanger as claimed in claim 1 wherein the common component is angled, and wherein the flow deflector extends at an angle with respect to a plane of the seal.

4. The heat exchanger as claimed in claim 1, wherein the flow deflector is a valve.

5. The heat exchanger as claimed in claim 4, wherein the valve is a flap valve which is responsive to pressure.

6. The heat exchanger as claimed in claim 4 wherein the valve, which is formed in one piece with the seal, has at least one bulge.

7. The heat exchanger as claimed in claim 4, wherein an aperture is defined by the third plate, wherein the aperture provides a flow connection between the bypass duct and the valve.

8. The heat exchanger as claimed in claim 1, wherein the bypass duct is formed only in the second base plate.

9. The heat exchanger as claimed in claim 1, wherein the third plate defines an aperture fluidly coupled to the bypass duct, wherein the flow deflector covers the aperture when the flow deflector is in the first position, wherein the bypass duct extends in a first direction and wherein the aperture extends in a second direction, substantially perpendicular to the first direction.

10. A heat exchanger, comprising:

a stack of plates which form ducts, with each of the plates having at least two openings which, in the plate stack, form at least one collecting duct and one distributor duct which connect the ducts in terms of flow, and a base plate arranged on the plate stack and having a seal for sealing off the heat exchanger and a flow deflector for manipulating the flow through the heat exchanger, the base plate including a first substantially planar base plate having a first opening fluidly coupled to the collecting duct and a second opening fluidly coupled to the distributor duct, a second substantially planar base plate having a third opening fluidly coupled to the first opening and the collecting duct and a fourth opening fluidly coupled to the second opening and the distributor duct, a third substantially planar base plate having a fifth opening fluidly coupled to the first opening, the third opening and the collecting duct and a sixth opening fluidly coupled to the second opening, the fourth opening and the distributor duct, wherein the second base plate is positioned between the first base plate and the third base plate, wherein the base plate forms a bypass duct that fluidly couples the collecting duct and the distributor duct, wherein the flow deflector is moveable between a first position in which flow of fluid through the bypass duct is inhibited and a second position in which flow of fluid through the bypass duct is permitted, wherein the seal and the flow deflector form a common component, and wherein the common component is generally planar.

11. The heat exchanger as claimed in claim 10 wherein the common component includes an integral fastener.

12. The heat exchanger as claimed in claim 10 wherein the common component is formed from metal.

13. The heat exchanger as claimed in claim 10 wherein a bypass duct is provided in the heat exchanger.

14. The heat exchanger as claimed in claim 10 wherein the flow deflector is a valve.

15. The heat exchanger as claimed in claim 14 wherein the valve is a flap valve which is responsive to pressure.

16. The heat exchanger as claimed in claim 14 wherein the valve, which is formed in one piece with the seal, has at least one bulge.

17. The heat exchanger as claimed in claim 14, wherein an aperture is defined by the third plate, wherein the aperture provides a flow connection between the bypass duct and the valve.

18. The heat exchanger as claimed in claim 10, wherein the heat exchanger is an oil cooler.

19. The heat exchanger as claimed in claim 10, wherein the bypass duct is formed only in the second base plate.

20. The heat exchanger as claimed in claim 10, wherein the third plate defines an aperture fluidly coupled to the bypass duct, wherein the flow deflector covers the aperture when the flow deflector is in the first position, wherein the bypass duct extends in a first direction and wherein the aperture extends in a second direction, substantially perpendicular to the first direction.

* * * * *